US005713320A

United States Patent [19]

Pfaff et al.

[11] Patent Number: 5,713,320

[45] Date of Patent: Feb. 3, 1998

[54] INTERNAL COMBUSTION ENGINE STARTING APPARATUS AND PROCESS

[75] Inventors: Joseph Lawrence Pfaff, Wauwatosa; Scott Lee Wesenberg, Hartland, both of Wis.

[73] Assignee: Gas Research Institute, Chicago, Ill.

[21] Appl. No.: 584,062

[22] Filed: Jan. 11, 1996

[51] Int. Cl.[6] ..... F02N 11/08

[52] U.S. Cl. ..... 123/179.3

[58] Field of Search ..... 123/179.1, 179.3, 123/179.4, 179.25, 179.26

[56] References Cited

U.S. PATENT DOCUMENTS

| | | | |
|---|---|---|---|
| 2,418,560 | 4/1947 | Sikorra | 388/844 |
| 2,452,127 | 10/1948 | James | 388/847 |
| 3,493,776 | 2/1970 | Porter | 290/31 |
| 3,728,604 | 4/1973 | Grygera | 318/459 |
| 3,908,130 | 9/1975 | Lafuze | 290/46 |
| 4,030,878 | 6/1977 | Kunath | 432/45 |
| 4,122,354 | 10/1978 | Howland | 290/31 |
| 4,219,739 | 8/1980 | Greenwell | 290/46 |
| 4,410,845 | 10/1983 | Lockyear | 318/459 |
| 4,459,536 | 7/1984 | Wirtz | 322/10 |
| 4,481,459 | 11/1984 | Mehl et al. | 322/10 |
| 4,626,696 | 12/1986 | Maucher et al. | 290/38 R |
| 4,633,154 | 12/1986 | Maeda | 318/373 |
| 4,720,638 | 1/1988 | Vollbrecht | 290/38 R |
| 4,774,915 | 10/1988 | Nguyen et al. | 123/179.3 |
| 4,797,602 | 1/1989 | West | 322/10 |
| 4,862,009 | 8/1989 | King | 290/22 |
| 4,873,950 | 10/1989 | Furuyama | 123/179.3 |
| 4,894,553 | 1/1990 | Kaneyuki | 290/31 |
| 4,894,570 | 1/1990 | Kaneyuki | 310/113 |
| 4,908,540 | 3/1990 | Motodate et al. | 310/240 |
| 4,918,323 | 4/1990 | Aso | 290/46 |
| 4,918,343 | 4/1990 | Heinrich et al. | 310/58 |
| 4,948,997 | 8/1990 | Ohmitsu et al. | 310/113 |
| 4,959,595 | 9/1990 | Nishimura | 318/138 |
| 5,012,177 | 4/1991 | Dhyanchand et al. | 322/10 |
| 5,101,780 | 4/1992 | Jones | 123/182.1 |
| 5,126,582 | 6/1992 | Sugiyama | 290/46 |
| 5,132,604 | 7/1992 | Shimane et al. | 322/10 |
| 5,189,355 | 2/1993 | Larkins et al. | 318/685 |
| 5,212,952 | 5/1993 | Yokoyama et al. | 60/721 |
| 5,219,397 | 6/1993 | Jones | 123/179.3 |
| 5,237,230 | 8/1993 | Sugiyama et al. | 310/113 |
| 5,254,917 | 10/1993 | Oda | 318/466 |
| 5,323,743 | 6/1994 | Kristiansson | 123/179.3 |
| 5,458,098 | 10/1995 | Yagi et al. | 123/179.3 |

FOREIGN PATENT DOCUMENTS 2-211089 8/1990 Japan .

*Primary Examiner*—Andrew M. Dolinar

*Attorney, Agent, or Firm*—Speckman, Pauley & Fejer

[57] ABSTRACT

An apparatus and process for starting internal combustion engines having one to three cylinders by first activating a reverse direction motor to drive the power system of the engine in reverse to its normal operating direction until it is positioned at or near the backside of a prior compression stroke and then activating a starter motor, preferably at initial high torque, and continuing operation until the engine is started. The apparatus and process achieves a significant decrease in the size and power requirements for starters.

18 Claims, 2 Drawing Sheets

(COMPARATIVE)

INTERNAL COMBUSTION ENGINE STARTING APPARATUS AND PROCESS

BACKGROUND OF THE INVENTION

1. Field of the Invention

This invention relates to an apparatus and method for starting internal combustion engines which reduces the total energy input required from the starter motor.

2. Description of Related Art

The state of the art regarding starter-generators/alternators, generally for internal combustion and gas turbine engines, is illustrated in the following U.S. Patents, many of them teaching various methods for increasing starter torque:

U.S. Pat. No. 3,493,776
U.S. Pat. No. 3,908,130
U.S. Pat. No. 4,122,354
U.S. Pat. No. 4,219,739
U.S. Pat. No. 4,459,536
U.S. Pat. No. 4,481,459
U.S. Pat. No. 4,626,696
U.S. Pat. No. 4,797,602
U.S. Pat. No. 4,862,009
U.S. Pat. No. 4,894,553
U.S. Pat. No. 4,894,570
U.S. Pat. No. 4,908,540
U.S. Pat. No. 4,918,323
U.S. Pat. No. 4,498,997
U.S. Pat. No. 4,959,595
U.S. Pat. No. 5,012,177
U.S. Pat. No. 5,126,582
U.S. Pat. No. 5,132,604
U.S. Pat. No. 5,212,952
U.S. Pat. No. 5,237,230

Electric motor control, particularly in starting and stopping, is exemplified by the following U.S. Pat. Nos.:

2,418,560
2,452,127
3,728,604
4,410,845
4,633,154
5,189,355
5,254,917 and Japanese Patent Number 2211089.

U.S. Pat. No. 4,030,878 teaches engaging the drive of a rotary furnace when the drum is not moving in a direction opposite to the normal driving direction to reduce the starting load.

U.S. Pat. No. 4,873,950 relates to an engine start control apparatus which electronically checks engine and other parameters to detect a start ready state prior to outputting a start ready signal.

U.S. Pat. No. 4,774,915 teaches rotation of a starter engagement means to align for translational engagement with an engine receiving meshing means.

Various attempts have been made to reduce the starting load required for multi-cylinder internal combustion engines. U.S. Pat. Nos. 5,101,780 and 5,219,397 teach selectively isolating a single cylinder during the start cycle with the exhaust valves in the other cylinders held open until ignition in the single cylinder. In another embodiment, the exhaust valves in all cylinders are held open for the first two revolutions of the flywheel and then the exhaust valve in a single cylinder is closed with the exhaust valves in the remaining cylinders opened until ignition in the single cylinder. U.S. Pat. No. 5,323,743 teaches use of a starter/generator which is controlled to provide full starter motor power during the compression stroke and full generator power during the piston power stroke at lower rpm and directly after start to reduce risk of stalling. Upon stalling, or upon a fresh start, the starter is again operated as a motor to turn the crankshaft to a position with as few pistons as possible within or near the compression stroke, and when the engine is to be started, to first operate the starter motor to slowly turn the crankshaft and then accelerate the crankshaft up to normal starting rpm.

SUMMARY OF THE INVENTION

Currently, starters for small internal combustion engines, such as single cylinder engines, have been required, upon initiation of the starting phase, to provide sufficient torque to overcome the compression stroke. When such an engine is shut down, coasting of the power system naturally stops at or near the beginning, or front side, of a compression stroke. This position presents the greatest torque requirements for the starter in moving the power system forward through the engine cycle, requiring the starter to initially generate torque sufficient to overcome the compression resistance as well as the starting friction of the system.

It is an object of this invention to provide an apparatus and process which reduces the torque, and thus the power, required for starting an internal combustion engine, particularly a single cylinder internal combustion engine.

This invention reduces the torque requirement for the starter by providing means to rotate the crankshaft, in reverse to its normal forward operating direction, to position it so that the engine cycle is at or near the backside of a prior compression stroke. When an engine stops, or is turned off, it coasts to a stopping position which positions the power system at or near the front side of the next compression stroke. This is normal since the compression stroke requires much more torque to overcome than the combustion, exhaust and intake portions of the engine cycle. This is the worst position from which to start the engine since the starter, itself, must provide sufficient torque to overcome the starting friction of the system as well as to overcome the compression stroke torque resistance. According to this invention, prior to or as a first step of the starting cycle, the crankshaft is rotated by a motor, in reverse to its normal forward operating direction, to a position where at least one piston is at or near the backside of the previous compression stroke. When ready to start, the starter is then engaged with its highest torque to overcome the starting friction of the system and to rotate the crankshaft, and flywheel, as rapidly as possible before approaching the front side of the next compression stroke. This will overcome the starting friction and build up sufficient inertia in the system to significantly reduce the starter torque necessary to pass through the compression stroke without stalling. Thus, a smaller starter motor and less electrical energy is required when using the apparatus and process of this invention. This invention is particularly suitable for single cylinder engines and four cycle engines, as used for relatively small power requirements, such as, lawn mowers, heat pumps, electrical generators, and the like, especially those using under-the-flywheel starters, as exemplified by U.S. Pat. No. 4,720,638.

BRIEF DESCRIPTION OF THE DRAWINGS

The above and further advantages of this invention will become apparent upon reading of the Description of Preferred Embodiments with reference to the drawings, wherein.

DESCRIPTION OF PREFERRED EMBODIMENTS

Figure 1:
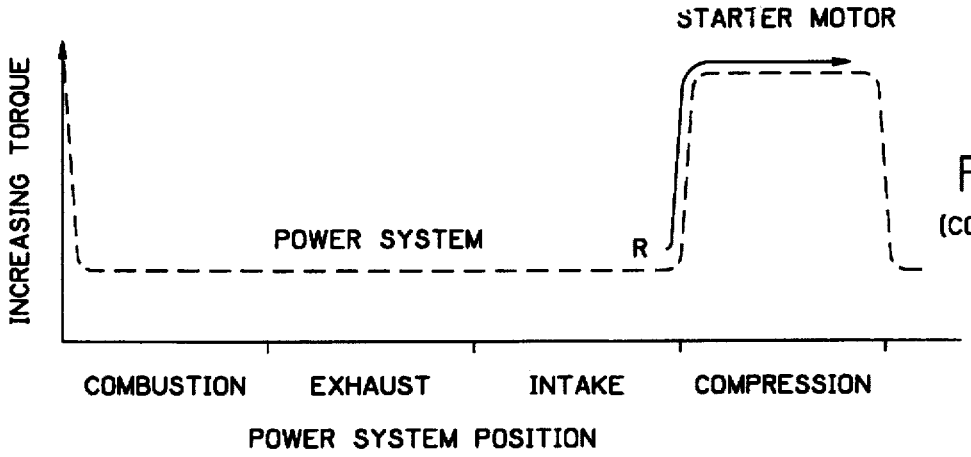
FIG. 1 is a comparative simplified schematic graph of torque required to overcome engine positions upon starting without use of this invention.

FIG. 1 schematically shows, by the dashed line, the torque required to drive a non-running single cylinder four cycle internal combustion engine power system through its combustion, exhaust, intake and compression cycles. When the engine has been shut down or stops, coasting of the power system will naturally come to rest at or near the beginning, or front side, of a compression stroke, shown in FIG. 1 as R. In engines not utilizing the present invention, the starter is engaged with the power system in its rest position R. To effect starts with the power system in the rest position R, the starter motor must initially provide sufficient torque to overcome the compression resistance as well as the starting friction of the system as illustrated by the solid line in FIG. 1.

Figure 2:
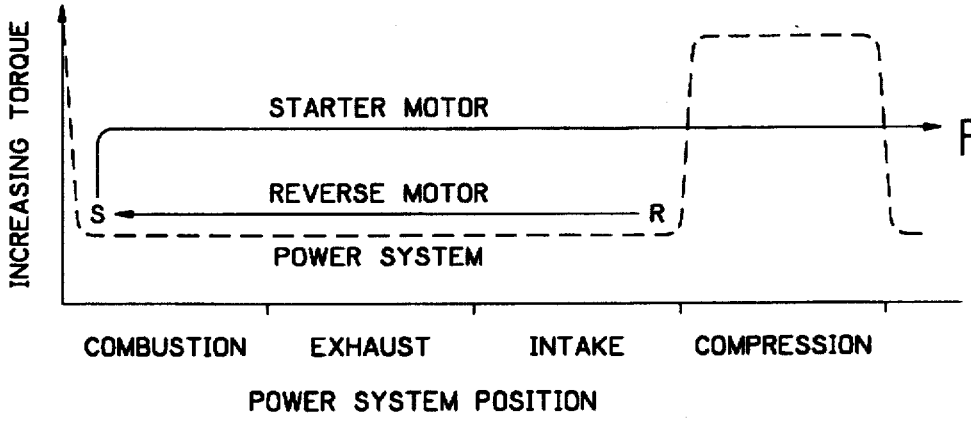
FIG. 2 is a simplified schematic graph of torque required to overcome engine positions upon starting according to this invention.

FIG. 2 schematically shows, by the dashed line, the torque required to drive the same non-running engine as FIG. 1 through a complete power system cycle. Again, when the engine has been shut down or stops, coasting of the power system will naturally come to rest at the position shown in FIG. 2 as R. According to this invention, after the engine has come to rest at position R and prior to activating the starter motor for the next operation of the engine, a reverse direction motor is activated to drive the power system in reverse to its normal operating direction to start position S, at or near the backside of a prior compression stroke. Upon reaching start position S, the reverse direction motor is deactivated. As shown by the solid line in FIG. 2, a starter motor is then activated, with the power system at start position S, to drive the power system in order through the combustion, exhaust, intake and compression portions of the power cycle in its normal operating direction, and continuing operation of the starter motor until the engine is started. As shown in FIG. 2, the starter motor is required to supply substantially less torque to drive the power system through the first compression portion of the cycle. This is due to inertia built up in the power system, particularly the flywheel, in first passing through the combustion, exhaust and intake portions of the cycle prior to passing through the first compression portion of the cycle. To increase the inertia built up in the power system, it is desirable that the starter initially cause the power system to rapidly accelerate to build up inertia in the power system, particularly the flywheel, by the time the power system encounters the front side of the first compression stroke in the starting cycle. As shown in FIG. 2, the starter motor does not require as high torque to drive the power system through the first compression stroke.

While the greatest benefit of this invention may be obtained in its application to single cylinder engines, it may also be used with internal combustion engines having two or three cylinders. Two cylinders and less are preferred, while a single cylinder engine is most preferred for use with the starting apparatus and process of this invention.

The reverse direction motor means used according to this invention rotates the crankshaft of the engine in reverse to its normal operating direction until the power system of the engine is at or near the backside of a prior compression stroke at start position. By the terminology "rotates the crankshaft" we mean that the reverse direction motor is drivingly coupled to a component of the power system, usually the flywheel, to drive the power system, usually including the flywheel, crankshaft, and piston(s), in reverse to their normal operating direction. The reverse direction motor may be coupled in any fashion which is prompt acting and independent of the direction and rotation of the starter motor. Typical starter motor couplings used on small engines may be divided in two classes: 1) positive engagement by means such as a solenoid forcing a pinion gear into a flywheel ring gear, belt driven, and electronically commutated motors; and 2) inertia engagement of a starter pinion gear with a flywheel ring gear by travel along a helix during operation of the starter motor. When starter motors with couplings of the first type are used in this invention, the starter motor itself may be used as the reverse direction motor by operation of the starter motor or starter/generator in reverse to its normal operating direction by means known to the art. When starter motors with couplings of the second type are used in this invention, a separate reverse direction motor must be used since it cannot effect a coupling to the engine in both forward and reverse directions and, also, requires too much time for engagement of the coupling. Thus, the terminology "reverse direction motor" as used in this description and claims may include use of the starter motor or starter/generator motor operating in reverse or may require use of a separate motor, depending upon the means for coupling to the engine. It is readily apparent that a separate reverse direction motor may be used even when a starter motor coupling of the first type is used, however in such cases, it is usually advantageous to use the starter motor operating in reverse to its normal operating direction.

The reverse direction motor is operated until the power system of the engine reaches the desired starting position at or near the backside of a prior compression stroke. The reverse direction motor is operated at a power significantly less than the power of the starter motor. Normally, the reverse direction motor is operated at a power of about 20 to about 50 percent of the power of the starter motor to rotate the crankshaft slowly to the desired starting position. Ascertainment of positioning at the desired starting position of the power system may be achieved in any suitable way. For example, the reverse rotation may be continued for a preset arc of rotation. Another method of determining positioning at the desired starting position is by detection of rotational position of the crankshaft or flywheel by means known to the art. Yet another method of determining positioning at the desired starting position is by detecting slowing of the reverse rotation. Upon reaching the desired starting position, the reverse direction motor is deactivated. The reverse direction motor may be operated at anytime between the power system of the engine coming to rest and prior to activation of the starter motor for starting the engine.

Figure 4:
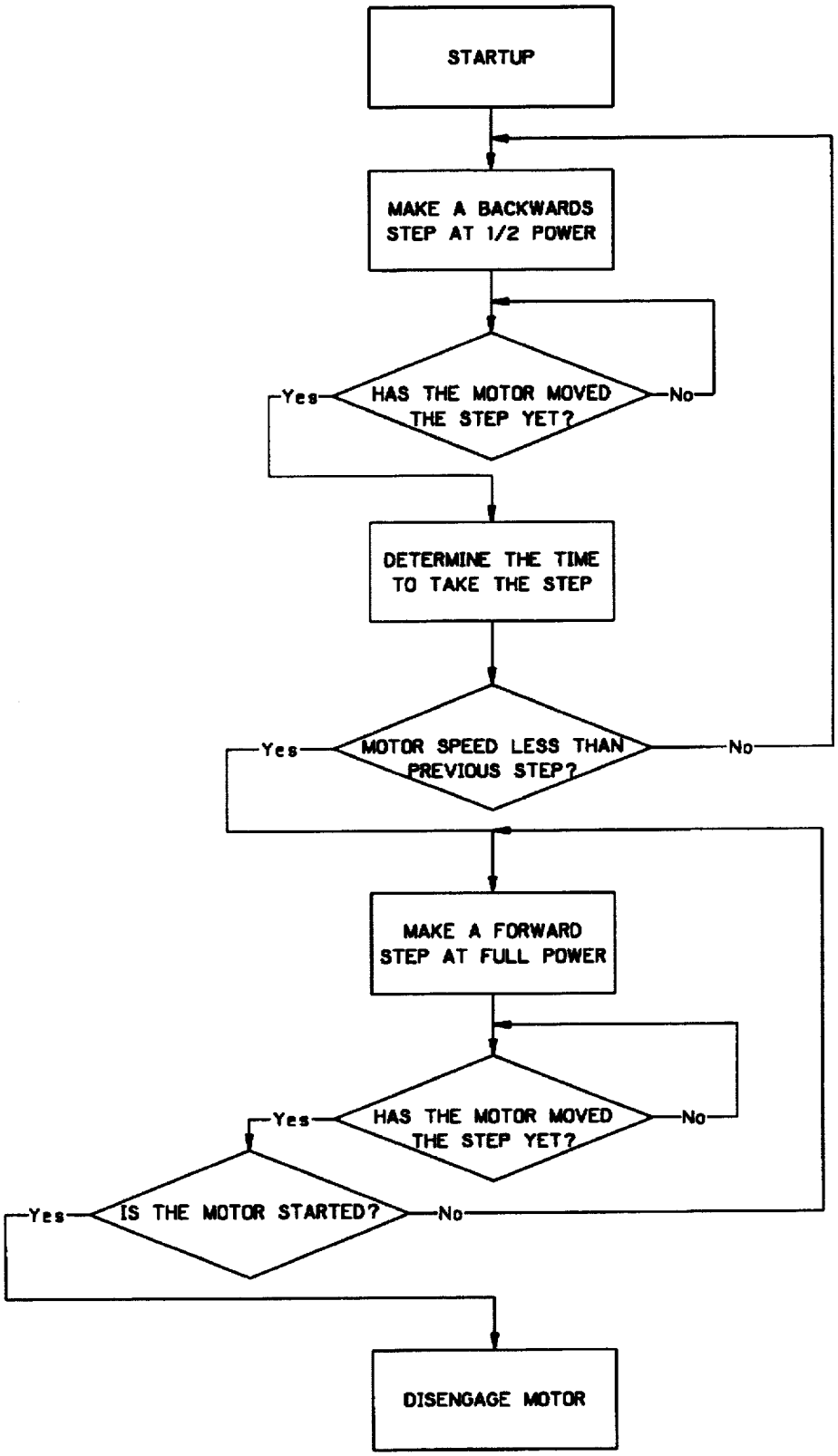
FIG. 4 is program scheme for use in one embodiment of this invention.

When the power cycle of the engine is in the desired start position, the starter motor is activated rotating the crankshaft in its normal operating direction until the engine is started. The starter motor may be any starter motor known to the art and may be coupled or engaged with the power system of the engine in any manner known to the art. In preferred embodiments for small engines, the starter motor means may be a combined starter motor/alternator of the known type having a stator of ferromagnetic core material with a plurality of angularly spaced current carrying field windings connected in a multi-phase configuration affixed to the engine body coaxial with the crankshaft and a permanent magnet rotor with a plurality of spaced permanent magnets having adjacent magnetic poles of opposite polarity. Preferably, the permanent magnet rotor is integral with the flywheel. Operation of the starter motor as the reverse motor means of this invention when electronic packages such as provided with a brushless motor control chip or similar device may be achieved by the logic level applied to the direction pin of the device being changed using additional circuitry to the reverse of the normal operating level. For example, if a high logic level will operate the starter motor in a forward direction, the logic level is changed to a low state to operate the motor in the reverse direction. In addition to the direction pin state change, the motor is operated at a reduced power by pulse width modulating the output of the motor control to the power devices at a frequency of about 20 to about 50 percent of the normal forward direction frequency. When the speed of the motor operating in reverse direction slows significantly, this is an indication that the motor has reached the back side of the previous compression stroke, and at this point, the direction pin state is changed to the forward logic state and the pulse width modulating is returned to 100 percent power. Other motors have electronic packages using a microprocessor to control motor operation. In this case, the start sequence will automatically conduct the reverse commutation of the starter motor as described through a programmatic approach as shown in FIG. 4 without any additional circuitry. For starter motors provided with belt driven or solenoid engaged coupling to the engine, the polarity applied to the motor may be reversed and the power supplied to the motor reduced for operation as a reverse direction motor and then returned to condition for operation as a starter motor through external circuitry, by means which will be readily apparent to one skilled in the art. Starter motors with inertia engagement coupling to the engine require a separate reverse direction motor which will be engaged in any suitable manner for operation of the engine in reverse direction for the desired period. Such a separate reverse direction motor may be provided with significantly less torque than the starter motor so that it will rotate the engine in the reverse direction slowly.

It is desired that the starter motor accelerate rapidly to obtain rapid acceleration in the speed of rotation of the power system, particularly the flywheel, prior to arriving at the front side of the first compression stroke in order to build up significant inertia in the flywheel. We have found that using the starter apparatus and process of this invention, the starter motor torque required to start an engine is significantly less than when using a conventional starter. We have found that use of the starter apparatus of this invention on a brushless motor required about seventy five percent of the torque required by a conventional starter. This allows the starter motor used to start engines according to this invention to be significantly underdesigned, as compared to conventional starter motors, requiring a significantly lesser electrical system, since the starter motor is usually the principal draw on an electrical system of a small engine.

Figure 3:
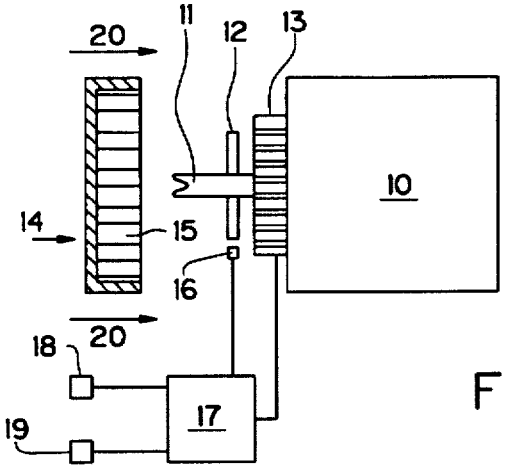
FIG. 3 is a schematic showing of one embodiment of a starter apparatus according to this invention.

FIG. 3 schematically illustrates one embodiment of a starting apparatus of this invention wherein internal combustion engine 10 is shown with crankshaft 11 extending therefrom. Stator 13 is affixed to the engine body coaxial with crankshaft 11. Electric current to the field windings of stator 13 is controlled by microprocessor 17 to vary the torque and direction of rotation to operate the combination of stator 13 and the rotor affixed to flywheel 14 as a reverse direction motor and as a starter motor, as described above. The starting apparatus of this invention may be controlled by any suitable micro-processor as known to the art to perform the desired functions. Position means 12 is affixed to engine 10 enabling determination of the position and/or speed of the power system of the engine by sensing means 16 transmitting a signal to microprocessor 17. As indicated in FIG. 3 by arrows 20, in operation flywheel 14, which acts as a rotor with permanent magnets 15 around its inner circumference, is in a position with its magnets generally aligned with the windings on stator 13 to operate as a motor. Electrical energy is supplied from energy source 18, a battery, controlled by microprocessor 17 and power switching devices for operation of the motor in the reverse direction function or in the forward starting function. Operation of the starting apparatus may be initiated in the usual fashion by switch 18, such as an ignition lock or a starter button.

While in the foregoing specification this invention has been described in relation to certain preferred embodiments thereof, and many details have been set forth for purpose of illustration it will be apparent to those skilled in the art that the invention is susceptible to additional embodiments and that certain of the details described herein can be varied considerably without departing from the basic principles of the invention.

We claim:

1. A process for starting an internal combustion engine comprising: activating a reverse direction motor to rotate the crankshaft of a one to three cylinder engine in reverse to its normal operating direction, continuing reverse rotation of said crankshaft until the power system of said engine is at or near the backside of a prior compression stroke, and then deactivating said reverse direction motor and activating a starter motor rotating said crankshaft in its normal operating direction driving said power system of said engine from said backside of said prior compression stroke until said engine is started, said reverse direction motor operating at a power significantly less than the power of said starter motor.

2. A process for starting an internal combustion engine according to claim 1 comprising continuing said reverse rotation of said crankshaft for a preset arc of rotation.

3. A process for starting an internal combustion engine according to claim 1 comprising continuing said reverse rotation of said crankshaft until said reverse rotation is slowed by said prior compression stroke.

4. A process for starting an internal combustion engine according to claim 1 comprising continuing said reverse rotation of said crankshaft to a preset position.

5. A process for starting an internal combustion engine according to claim 1 wherein said activating said reverse direction motor comprises activating said starter motor in reverse to its normal operating direction.

6. A process for starting an internal combustion engine according to claim 1 wherein said activating said reverse direction motor comprises activating a reverse direction motor which is a separate motor from said starter motor.

7. A process for starting an internal combustion engine according to claim 1 wherein said rotating said crankshaft by said starter in said normal operating direction is rapidly accelerated upon its initiation.

8. A process for starting an internal combustion engine according to claim 1 wherein said engine is a single cylinder engine.

9. A process for starting an internal combustion engine according to claim 1 having a single cylinder wherein said activating said reverse direction motor comprises activating said starter motor in reverse to its normal operating direction at a power significantly less than the power of said starter in said normal operating direction and said rotating said crankshaft in said normal operating direction is rapidly accelerated upon its initiation.

10. An apparatus for starting an internal combustion engine comprising: reverse direction motor means capable of rotating the crankshaft of a one to three cylinder engine in reverse to its normal operating direction, reverse direction motor activating means to activate said reverse direction motor means, reverse direction motor deactivating means to deactivate said reverse direction motor means when the power system of said engine is at or near the backside of a prior compression stroke, and starter motor means capable of rotating the crankshaft of said engine in its normal operating direction driving said power system of said engine from said backside of said prior compression stroke until said engine is started, said reverse direction motor means operating at a power significantly less than the power of said starter motor means.

11. An apparatus for starting an internal combustion engine according to claim 10 further comprising control means for continuing said reverse rotation of said crankshaft for a preset arc of rotation.

12. An apparatus for stating an internal combustion engine according to claim 10 further comprising speed sensing means capable of detecting slowing of said reverse rotation and signalling said reverse direction motor deactivating means upon said determining of slowing.

13. An apparatus for starting an internal combustion engine according to claim 10 further comprising position sensing means capable of determining rotation position of said crankshaft and signalling said reverse direction motor deactivating means upon said crankshaft reaching a preset position at or near the backside of a prior compression stroke.

14. An apparatus for starting an internal combustion engine according to claim 10 wherein said reverse direction motor means comprises means for operating said starter motor means in reverse to its normal operating direction.

15. An apparatus for starting an internal combustion engine according to claim 10 wherein said reverse direction motor means comprises a motor separate from said starter motor means.

16. An apparatus for starting an internal combustion engine according to claim 10 wherein rotating said crankshaft by said starter is rapidly accelerated upon its initiation.

17. An apparatus for starting an internal combustion engine according to claim 10 wherein said engine is a single cylinder engine.

18. In an internal combustion engine starter of the type having starter motor means capable of rotating the crankshaft of said engine in its normal operating direction until said engine is started, the improvement comprising: reverse direction motor means capable of rotating said crankshaft at a speed significantly less than the speed of rotation of said crankshaft, by said starter in reverse to its normal operating direction to place the power system of said engine at or near the backside of a prior compression stroke and said starter, motor comprising means for providing rapid acceleration upon its activation.

* * * * *